US011542674B2

(12) United States Patent
Lyons

(10) Patent No.: US 11,542,674 B2
(45) Date of Patent: Jan. 3, 2023

(54) SCOOPING DEVICE WITH EMPTYING MECHANISM

(71) Applicant: Michael Lee Lyons, Standish, ME (US)

(72) Inventor: Michael Lee Lyons, Standish, ME (US)

( * ) Notice: Subject to any disclaimer, the term of this patent is extended or adjusted under 35 U.S.C. 154(b) by 326 days.

(21) Appl. No.: 16/804,065

(22) Filed: Feb. 28, 2020

(65) Prior Publication Data

US 2020/0277744 A1 Sep. 3, 2020

Related U.S. Application Data

(60) Provisional application No. 62/919,163, filed on Mar. 1, 2019.

(51) Int. Cl.
*E01H 5/02* (2006.01)

(52) U.S. Cl.
CPC ..... *E01H 5/02* (2013.01)

(58) Field of Classification Search
CPC ..... E01H 5/02; A01B 1/028
USPC ..... 294/54.5; 254/131.5; 37/265, 285
See application file for complete search history.

(56) References Cited

U.S. PATENT DOCUMENTS 584,827 A * 6/1897 McIndoo
2,629,624 A * 2/1953 Nelles ..... A01B 1/02 294/57
3,833,262 A * 9/1974 Tasse ..... B62B 1/24 298/3
4,302,894 A * 12/1981 Emma ..... B62B 1/147 37/434
5,018,282 A * 5/1991 Hong ..... E02F 3/02 37/434
6,922,920 B1 * 8/2005 Stratz ..... E01H 5/02 294/181
7,581,771 B2 * 9/2009 Rosine ..... A01B 1/02 294/56
7,681,932 B2 * 3/2010 Chang ..... E01H 5/02 294/54.5
9,909,273 B2 * 3/2018 Al Adawi ..... E01H 5/02
10,106,941 B1 * 10/2018 Nam ..... E01H 5/02

* cited by examiner

*Primary Examiner* — Dean J Kramer

(57) ABSTRACT

A manually operated scooping device for moving bulk items such as snow that includes a foot operated lifting mechanism that causes the scoop to pivot forward to eject the contents of the scoop, the scoop configured to gather and push the bulk items along a surface area until it reaches a dumping area, at which point a user may use the lifting mechanism to pivot the scoop and dump the materials.

8 Claims, 12 Drawing Sheets

SCOOPING DEVICE WITH EMPTYING MECHANISM

BACKGROUND INFORMATION

Field of the Invention

The invention relates to scooping devices and, more particularly, scoop devices that incorporate a mechanism that empties the contents of the scoop without having to lift the device.

Discussion of Prior Art

Shovels and scoops are devices that are used to move or remove bulk materials such as, for example, snow, soil, gravel and/or sand, from a surface area. Snow shovels and snow scoops, in particular, are frequently used to move snow off of and/or away from walkways, driveways, and roadways. Shovels and scoops come in a variety of designs, each of which is constructed to move the bulk material in a different manner and each of which generally includes a handle and scoop.

Most snow shovels, for example, are designed to lift snow up and off of a surface while snow scoops are generally intended to push snow along a surface to a desired deposit location. While these devices are generally effective for moving snow, they also require a lot of manual effort. With shovels, a user generally bends over at the waist, scoops a load of snow, and then tosses it or carries it to another location where it is deposited. Snow scoops are generally intended to push snow rather than lift it, and are therefore easier on the upper body, however, the snow must still be moved off of the surface after it is pushed to the end of a path or driveway, either by lifting the snow scoop or by using a smaller shovel.

Mechanized snow removal devices also exist to alleviate the stress of lifting heavy loads of snow, such as snow blowers/throwers and electric shovels. However, each of these types of devices require a power source, usually a gas powered engine, a portable battery, or an electric power cord. In each case, the power source is cumbersome, adds weight, and adds expense.

What is needed, therefore, is a manually operated device that is able move and lift snow without requiring the user to use his/her arms, back and upper body to endure the bulk of the lifting.

BRIEF SUMMARY OF THE INVENTION

The invention is a snow scoop that includes a foot operated lifting mechanism that transfers the snow from the scoop to the desired dumping location. In general, the snow scoop is used to push snow across a snow covered area until it reaches the edge of the area, for example a walkway or driveway, at which point the user uses his/her foot to operate a lifting mechanism, which forces the scoop to pivot in a manner that causes the snow to exit the scoop onto the desired dumping area.

The snow scoop generally includes three distinct components: 1) a scoop; 2) a handle; and 3) the foot operated lifting mechanism. The scoop is primarily laterally oriented, having an open front end, a closed back end, and two sides that increase in height from the front end to the back end. The handle has a modified u-shape, with outer ends attached to either side of the scoop and the middle portion acting as a grip for the user to push against.

The foot operated lifting mechanism generally has a u-shape and is pivotably coupled to either side of the scoop. It has an angled orientation that generally follows the same path as the lower ends of the handle and works in connection with the handle. For example, each side of the lift mechanism may have a pair of parallel guide bars that are positioned on an upper side and lower side of each of the lower ends of the handle to support and control the position of the scoop. The lift mechanism may also, additionally or alternatively, be slideably coupled to each of the handles lower ends using a number of conventional means. As such, the lift mechanism is elevated above the surface in normal operations (e.g. when a user is pushing/scooping snow), and the user need only step down on the lift mechanism to cause the scoop to pivot forward and eject the snow.

The primarily lateral orientation of the scoop is designed to more effectively collect snow as the device is pushed along a snow covered area. The lift mechanism is a direct lever which provides a leveraged force to a front portion of the scoop at a hinge point. While precise dimensions and specifications may vary, a suitably sized device may have a scoop that is approximately 21 inches in width at the front opening, 24 inches in length with a depth at the back end wall of 6-8 inches. Constructing the lifting mechanism that has a downstroke, e.g. a distance of engagement to ground contact, of roughly 10 inches is also particularly beneficial.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1:
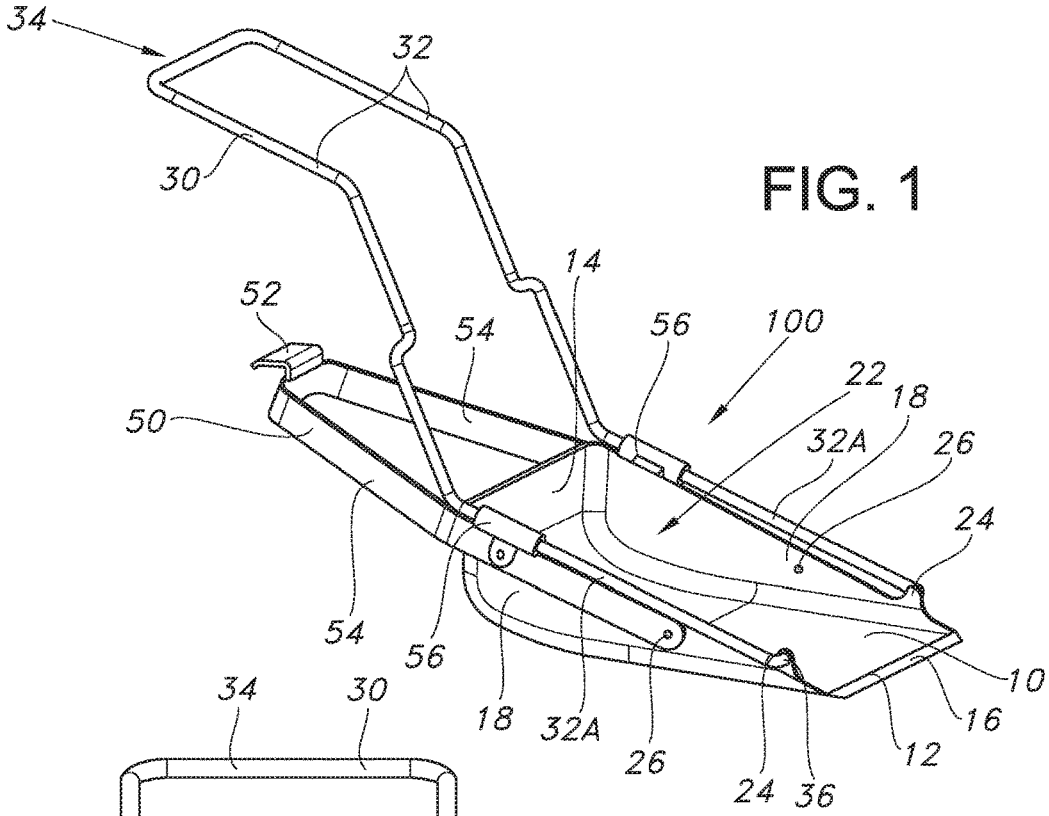
FIG. 1 is a perspective view of the snow scoop according to the invention showing the front and side of the scoop showing the scoop oriented for pushing snow.
Figure 4:
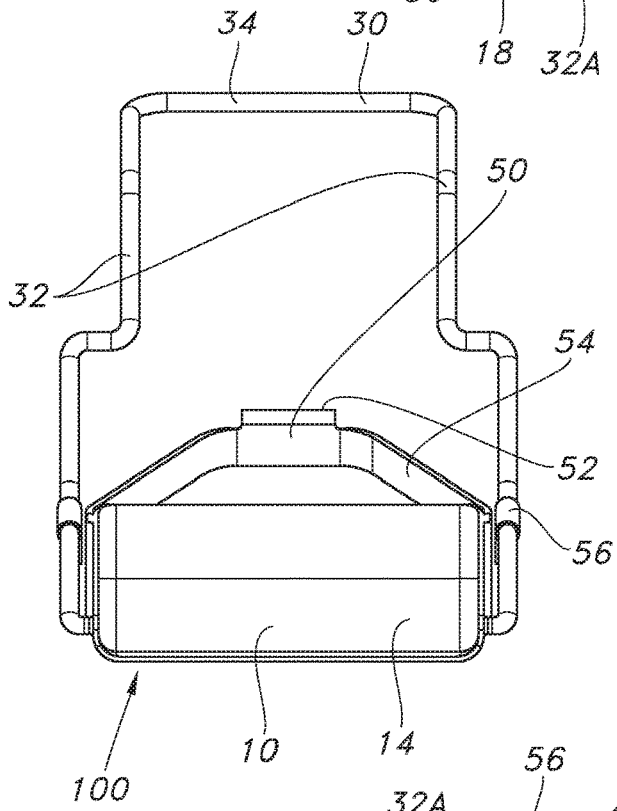
FIG. 4 is a rear view of the scoop.
Figure 3:
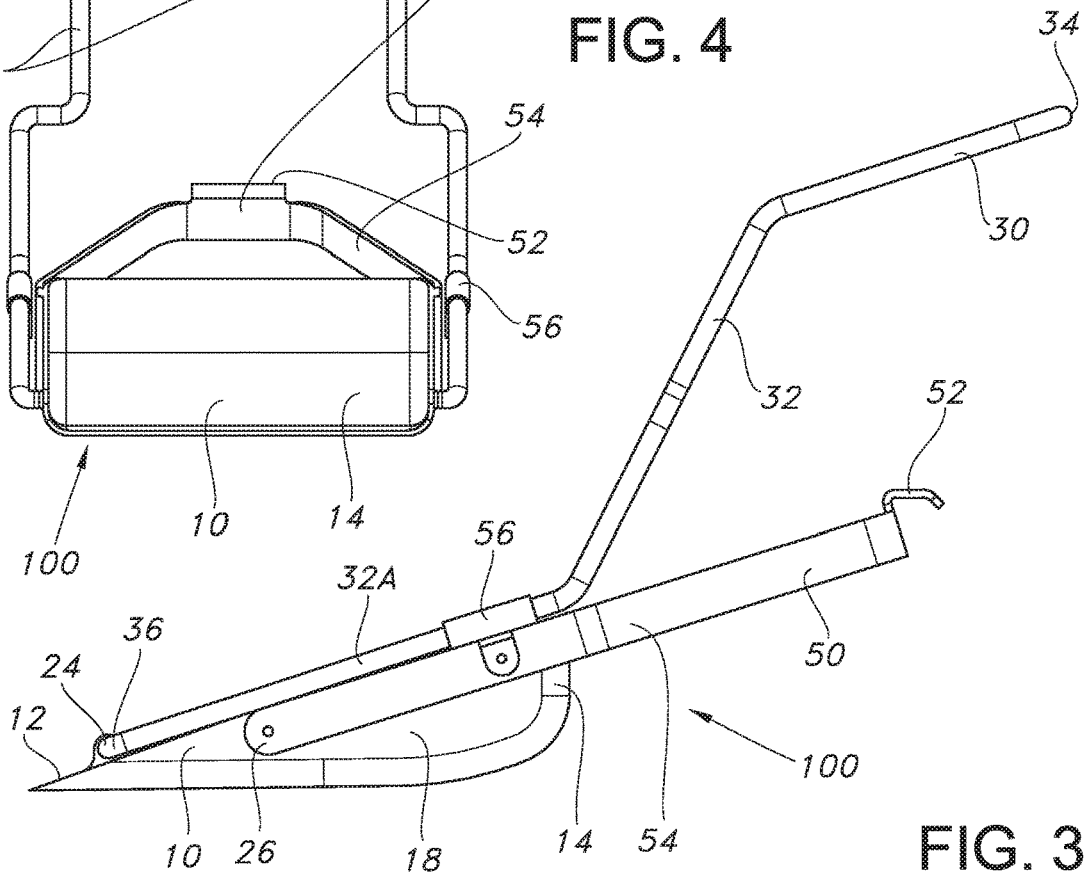
FIG. 3 is a side view of the scoop.
Figure 2:
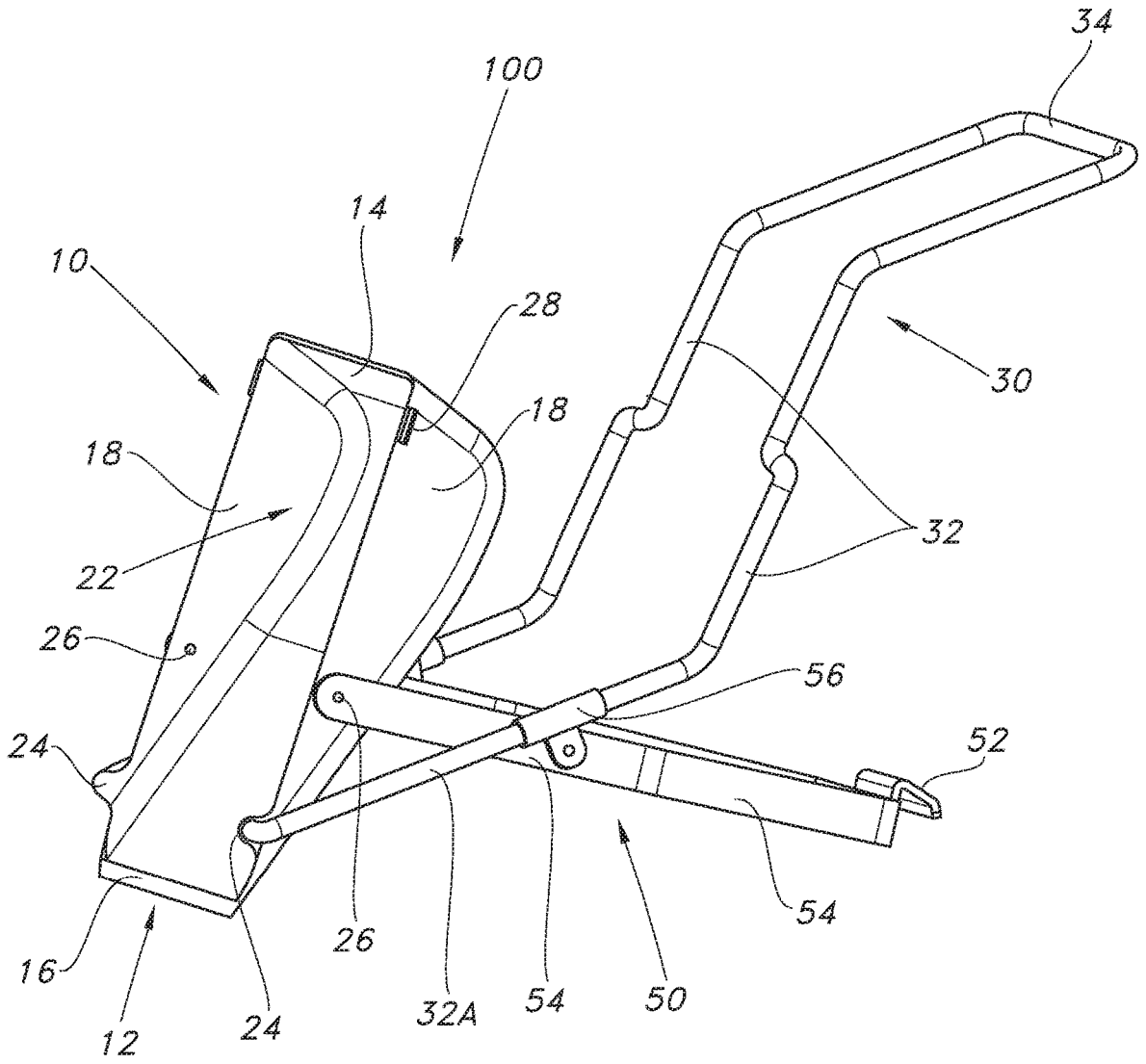
FIG. 2 is a perspective view of the snow scoop showing the scoop and lifting mechanism in a position to empty the scoop.
Figure 5:
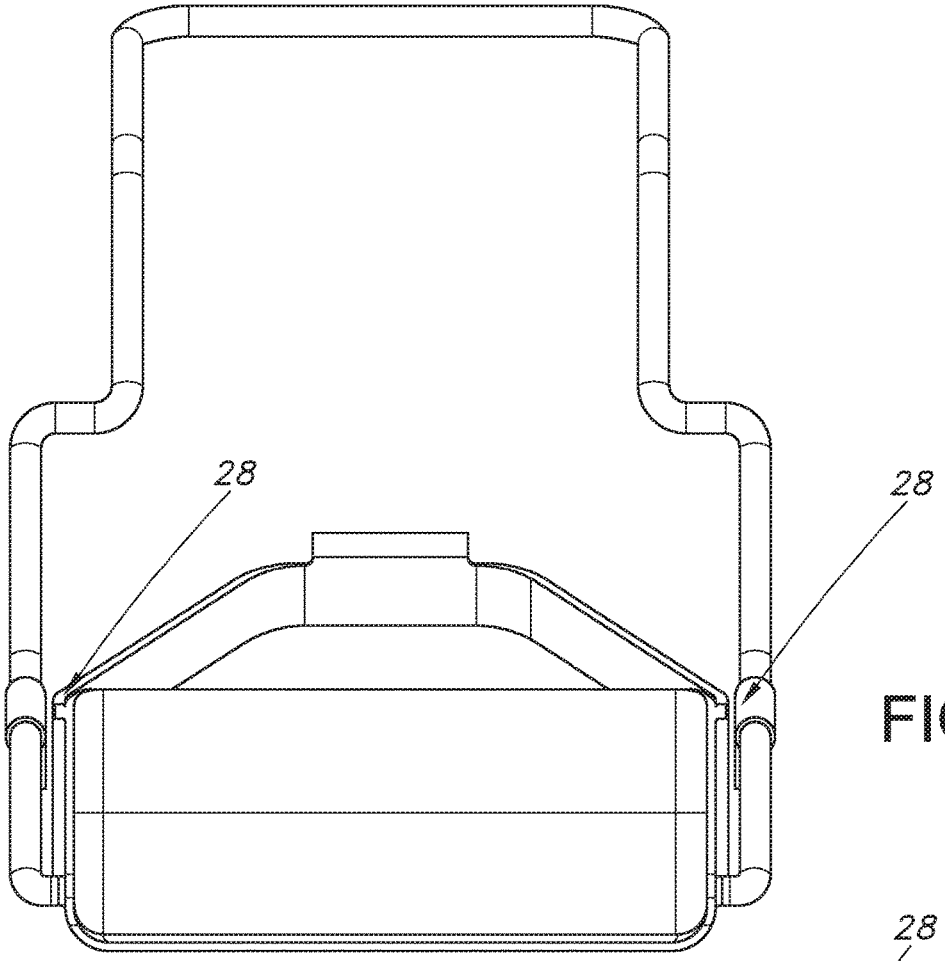
FIG. 5 is a rear view of the scoop showing the scoop restraints.
Figure 6:
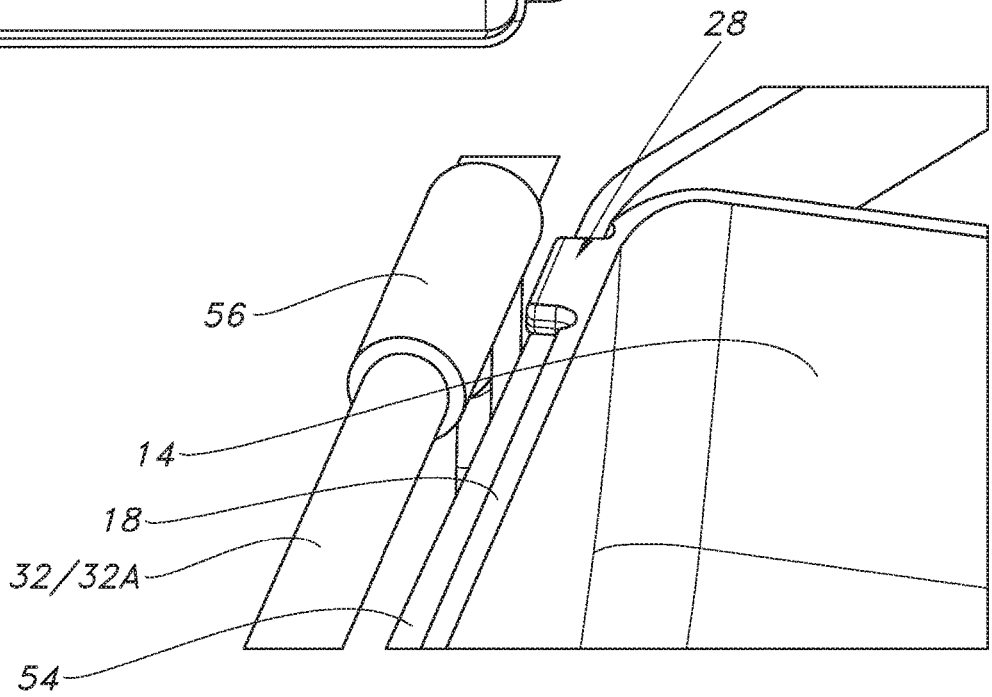
FIG. 6 is a magnified view of the scoop restraint.
Figure 7:
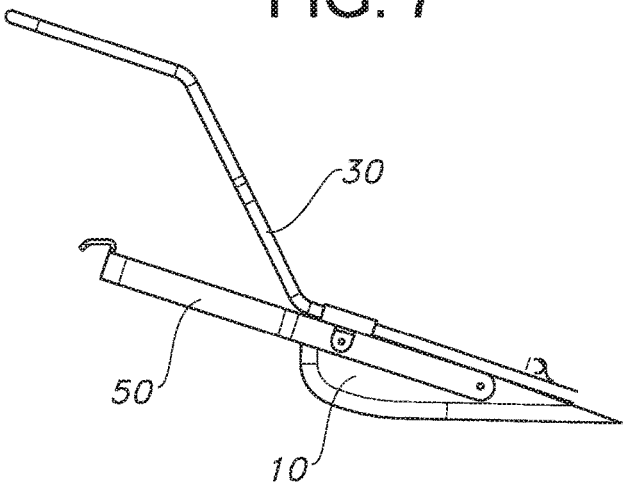
FIG. 7 is a side view of the scoop in its normal pushing position.
Figure 8:
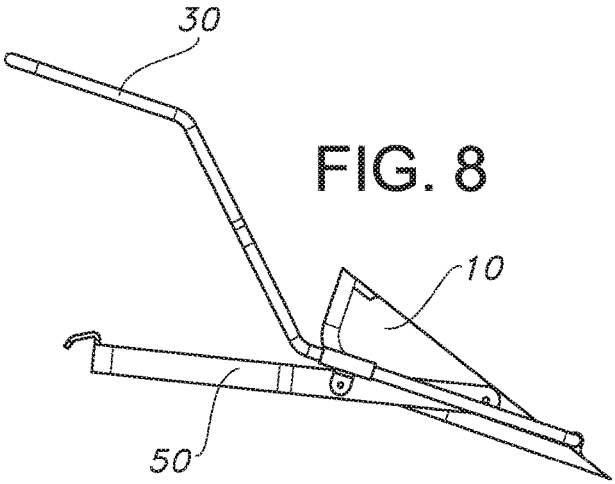
FIG. 8 is a side view of the scoop as it begins to tilt.
Figure 9:
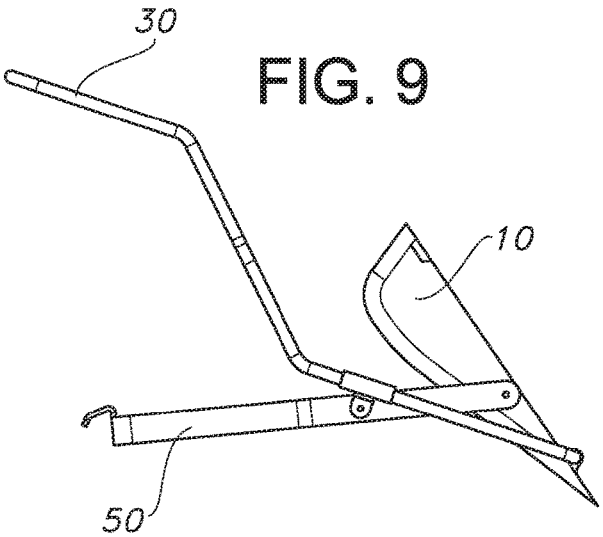
FIG. 9 is a side view of the scoop approximately half way through its tilting action.
Figure 10:
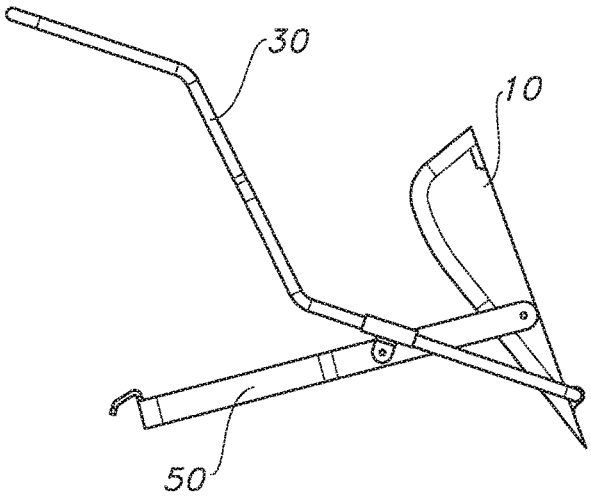
FIG. 10 is a side view of the scoop in an extended tilt.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-10 illustrate a first embodiment of the scoop device 100 according to the invention, including a scoop 10, a handle 30, and a lift mechanism 50. In its basic configuration the snow scoop 100 operates in a similar manner to other conventional scoops, with a user holding onto and pushing against the handle 30 in order to push the scoop 10 along a surface area to collect bulk materials such as snow. However, when the user reaches an area where he/she wishes to deposit the snow that has been collected in the scoop rather than lifting the scoop to toss or drop the snow, or lifting the handle 30 upward to cause a tilt that enables to the snow to slide out into a pile, the user uses his or her foot to press down on the lifting mechanism 50, which causes the scoop to pivot forward and eject or propel the snow out of the scoop. Releasing the lifting mechanism 50 causes the scoop 10 to return to its normal operating position.

FIGS. 7-10 illustrate the progression of the scoop 10 as the foot peddle is pressed down and, in this embodiment, sleeves 56 on the lifting mechanism 50 slide down lower sections of arms 32 of the handle 30 to cause the scoop 10 to pivot forward. In general, this disclosure often discusses the scooping device in terms of its use with snow, however, it is understood that this particular use is merely an example and not limiting in anyway.

The scoop 10 is likely approximately rectangular or slightly tapered in shape, having a length that is at least slightly greater than its width. For example, while the dimensions may vary, having a length that is approximately 24 inches and a width of approximately 21 inches is particularly advantageous. The scoop 10 has front end 12 that is open and a back end wall 14 that is a stop wall. The tip 16 of the front end 12 is likely to be tapered downward and may have a protective lip. The scoop 10 also includes two sidewalls 18 that are tapered, extending from a low point at or near the open front end 12 and rising to a height that is approximately equal to that of the back end wall 14. The scoop may also be designed to have a well area 22 near a back portion of the scoop 10 to contain a larger volume of snow. The scoop 10 also may include restraints or stops 28, best shown in FIGS. 5 and 6, on an upper portion of the sidewalls 18 that rest atop the handle 30 when the scoop is in its normal/pushing position. The snow scoop 10 may be made of any suitable material, for example, it may be made of high-density polyethylene, or fiber glass, or carbon fiber. The snow scoop 10 also has two handle attachment points 24 and two lift attachment points 26. The attachment points 24, 26, may be constructed using any suitable conventional means, for example, they may simply be holes or openings that are cut into or formed as a part of the material. The attachment points 24, 26, may or may not be reinforced using conventional means.

Figure 18:
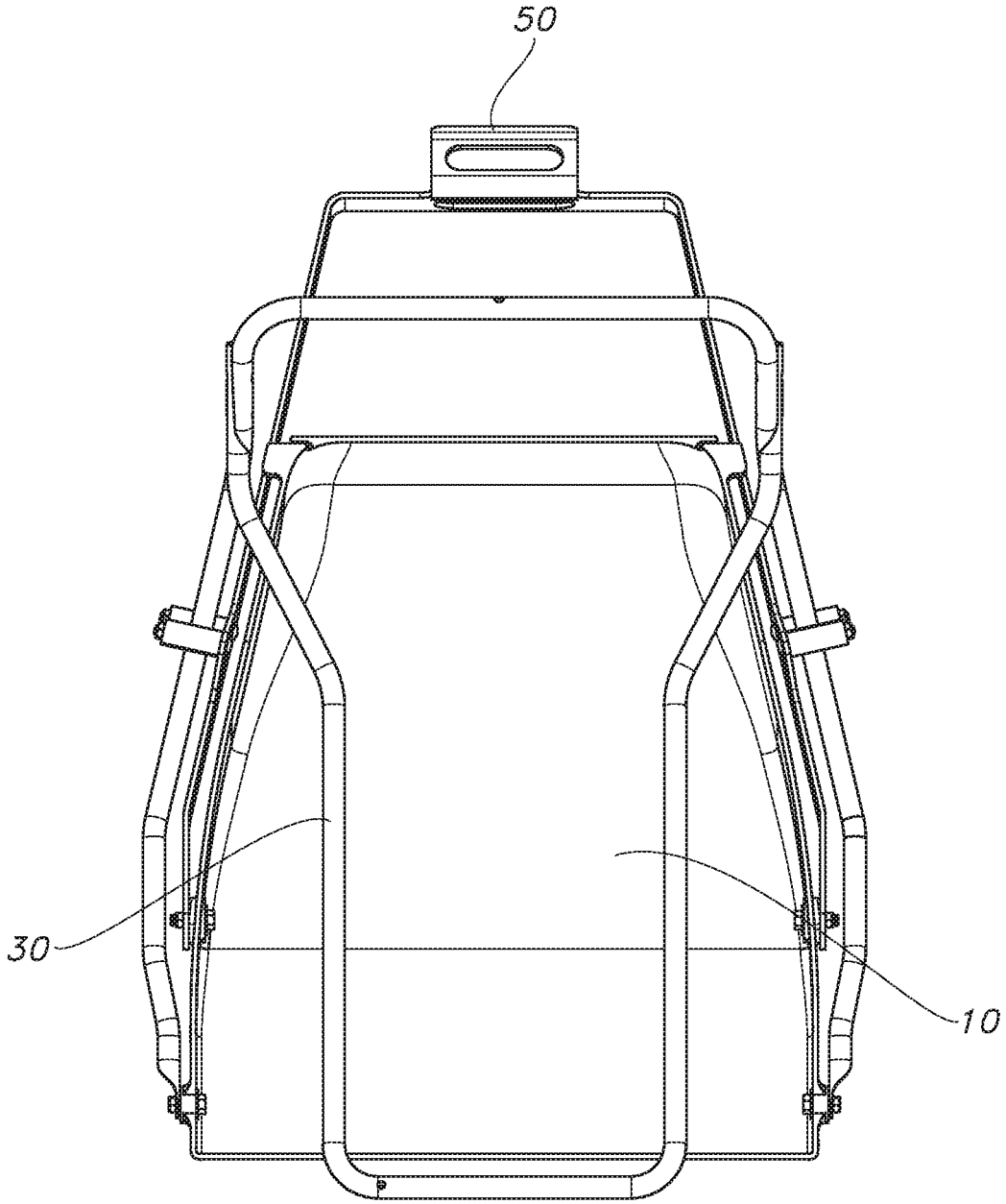
FIG. 18 is a top view of the scoop having the handle folded into the scoop.

The handle 30 has an approximately U-shape, having two arms 32 that attach to either side of the scoop 10 and a middle portion 34 that is a gripping area which the user holds onto and pushes against. The handle 30 extends upward from the scoop at an angle that is designed to enable ergonomic handling by the user. As shown in the figures, the upper portion of the handle may extend inward such that the distance between the arms 32 is narrower at the top than at the bottom. The handle 30 may be constructed as a single piece, it may be comprised of multiple pieces that are assembled using conventional means, and/or it may have a hinge that allows the upper portion of the handle to fold into the lower portion and into the scoop 10, as shown in FIG. 18, for easy storage and/or transport.

Lower sections of the arms 32A generally follow the profile of upper portions of the scoop's 10 sidewalls 18. The ends of the arms 36 connect to the handle attachment points 24 at a pivot point such that the scoop 10 is pivotable about this pivot point. The pivotable connection may be made using any suitable conventional means.

The lifting mechanism 50 is approximately U-shaped and wraps around the outer sides of the scoop 10 and beneath a portion of the handle 30, more specifically, the lifting mechanism 50 has a foot peddle 52 at or near a mid-point and two arms 54 that are positioned along and around the outer sides of the scoop 10. The two arms 54 slide along to the lower section 32A of each arm 30, and are pivotably attached to the scoop 30. The foot peddle 52 extends beneath the scoop 10 and below the center 34 of the arms 30 where it is accessible to the user. As the user presses on the foot peddle 52 arms 54 slide down along the lower sections 32A and as the lifting mechanism 50 slides it exerts a forward force on the scoop 10 causing the scoop 10 to pivot forward and eject its contents.

This sliding effect of the lifting arms 54 along the handle arms 32 may be accomplished in a number of ways. For example, as shown in FIGS. 1-10, sleeves 56 may be coupled to the lifting mechanism and loosely and slideably coupled to the lower sections of the arms 32. The sleeves are sized to be slightly larger than the lower sections 32A of the arms 32 and may be lubricated or use a ball bearing system. As the user pushes the foot peddle the sleeves 56 slide down the lower sections of the arms 32A and the scoop 10 tilts forward.

Figure 11:
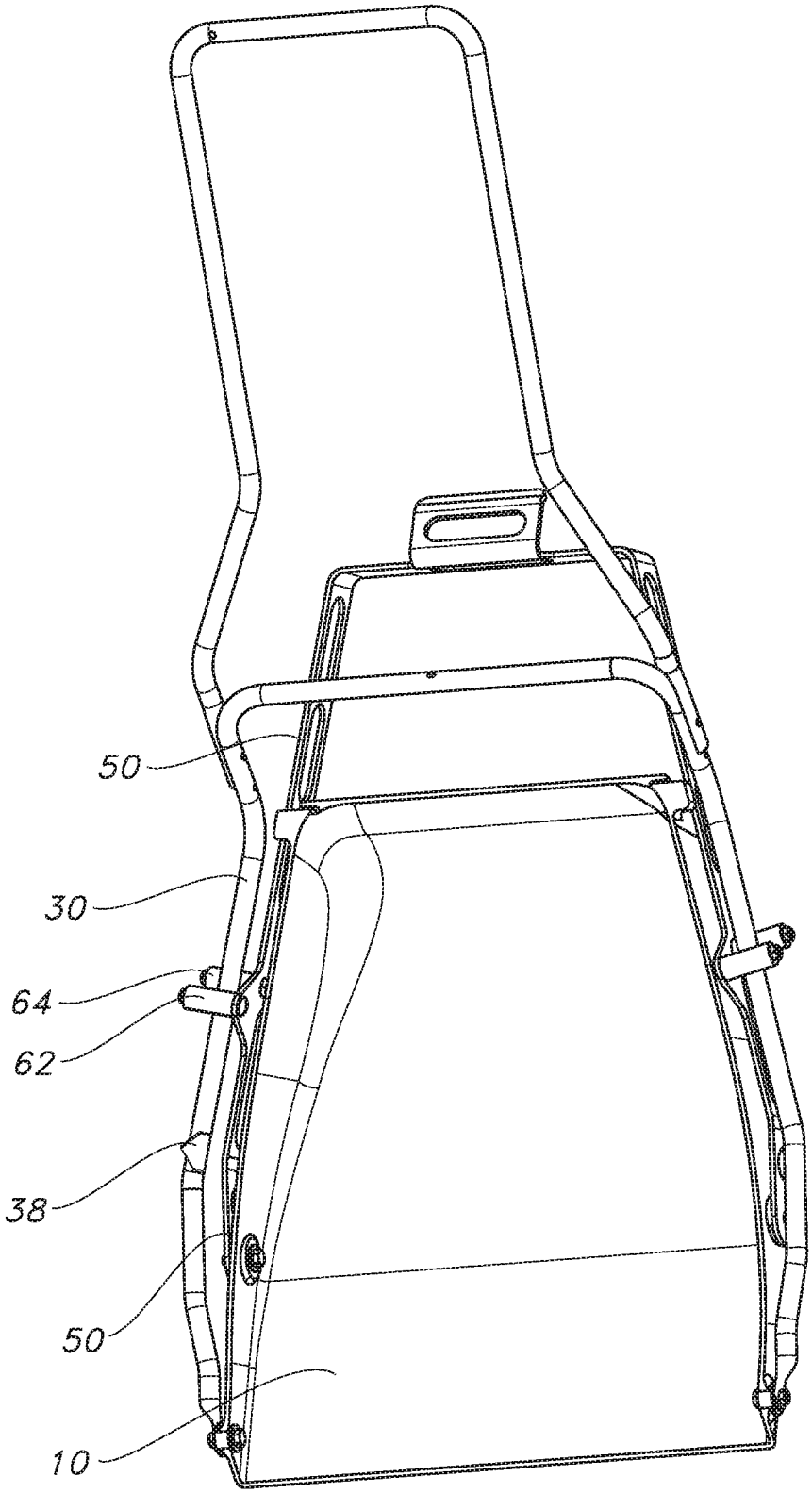
FIG. 11 is a top perspective view of the device having a second embodiment of the lift sliding mechanism.
Figure 12:
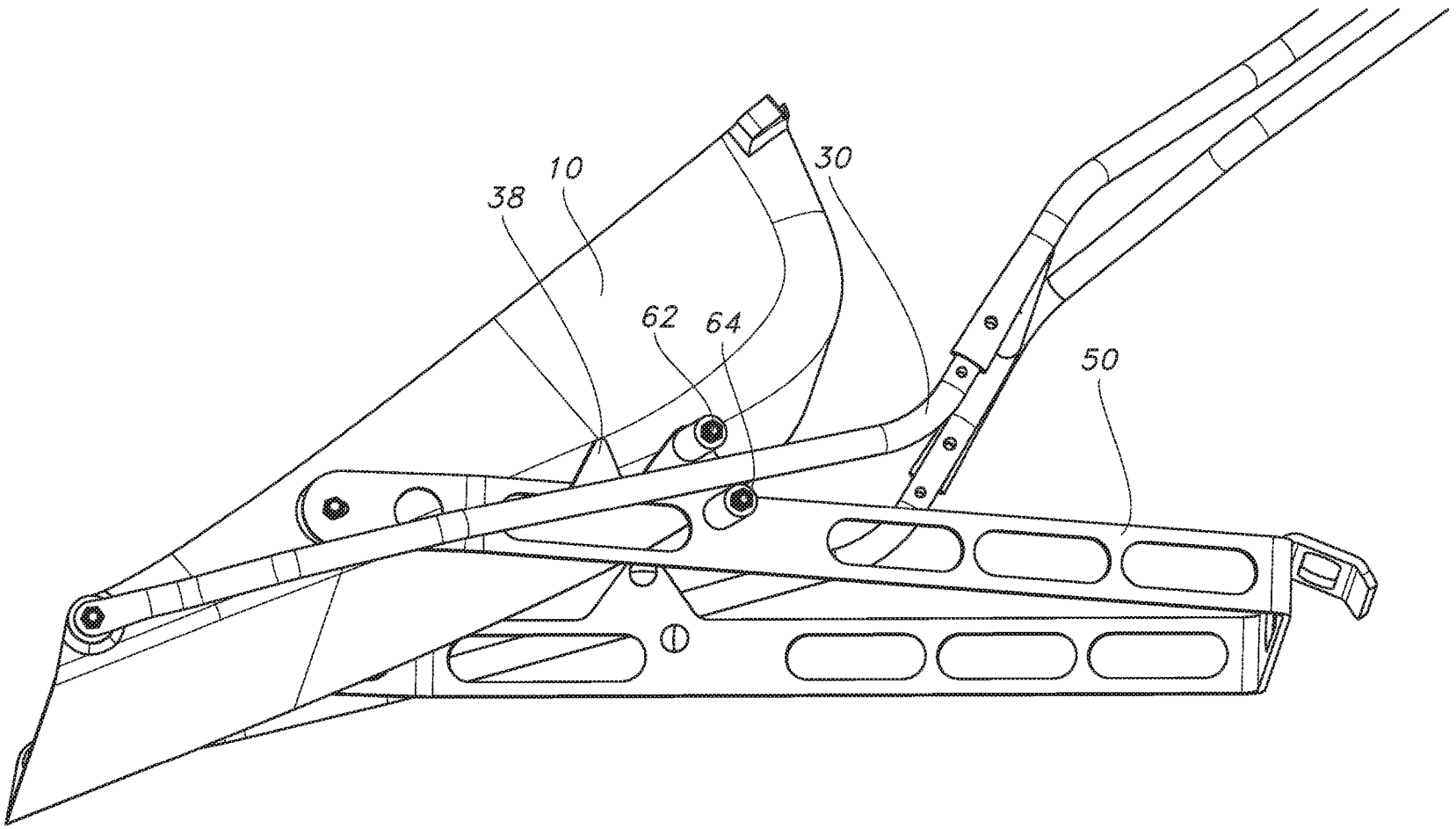
FIG. 12 is a side view of the second embodiment of the lifting mechanism.
Figure 13:
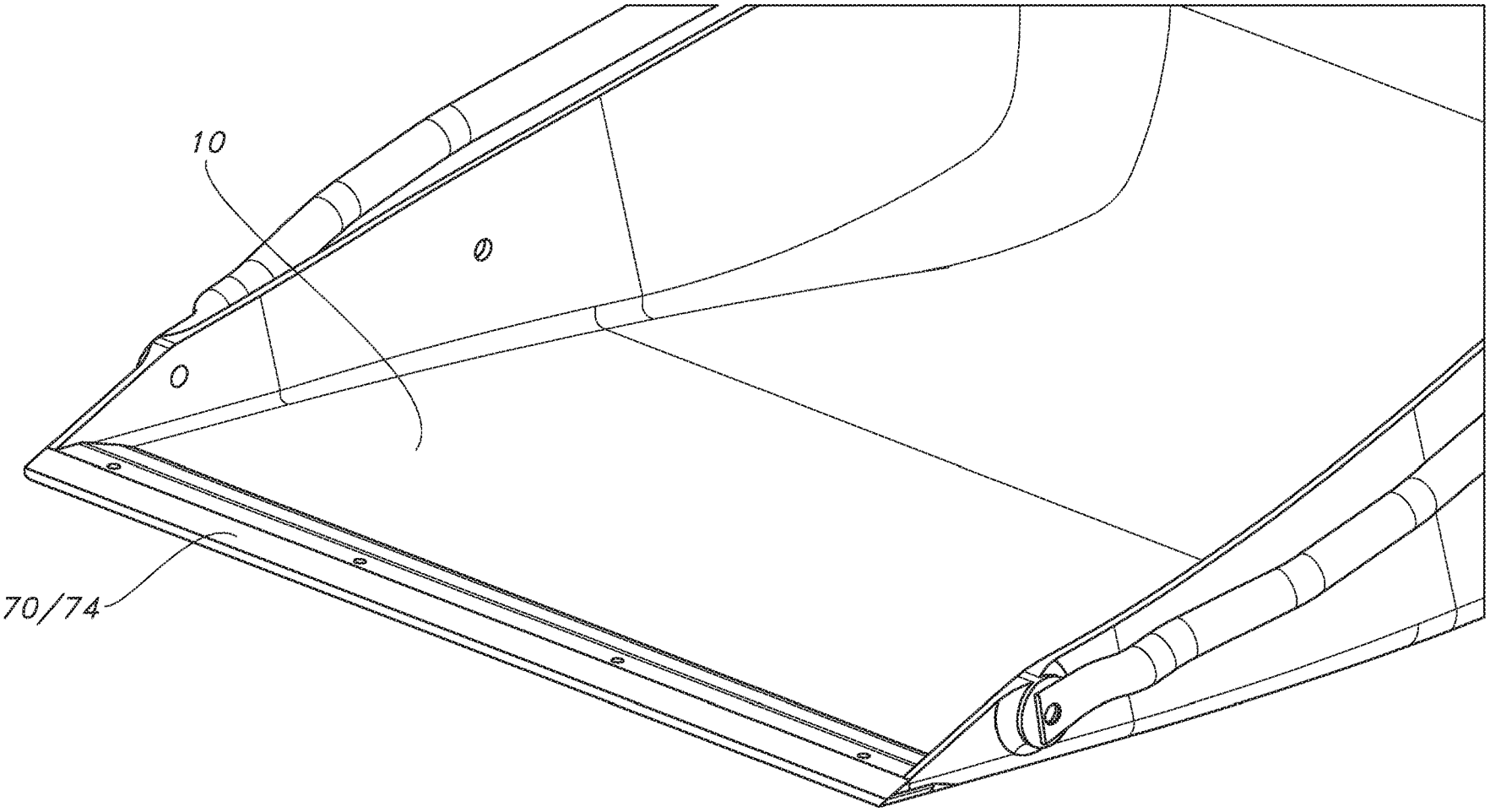
FIG. 13 is a front perspective view of the scoop having a separate lip.
Figure 14:
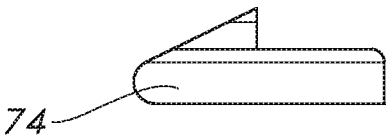
FIG. 14 is side view of the lip insert.
Figure 15:
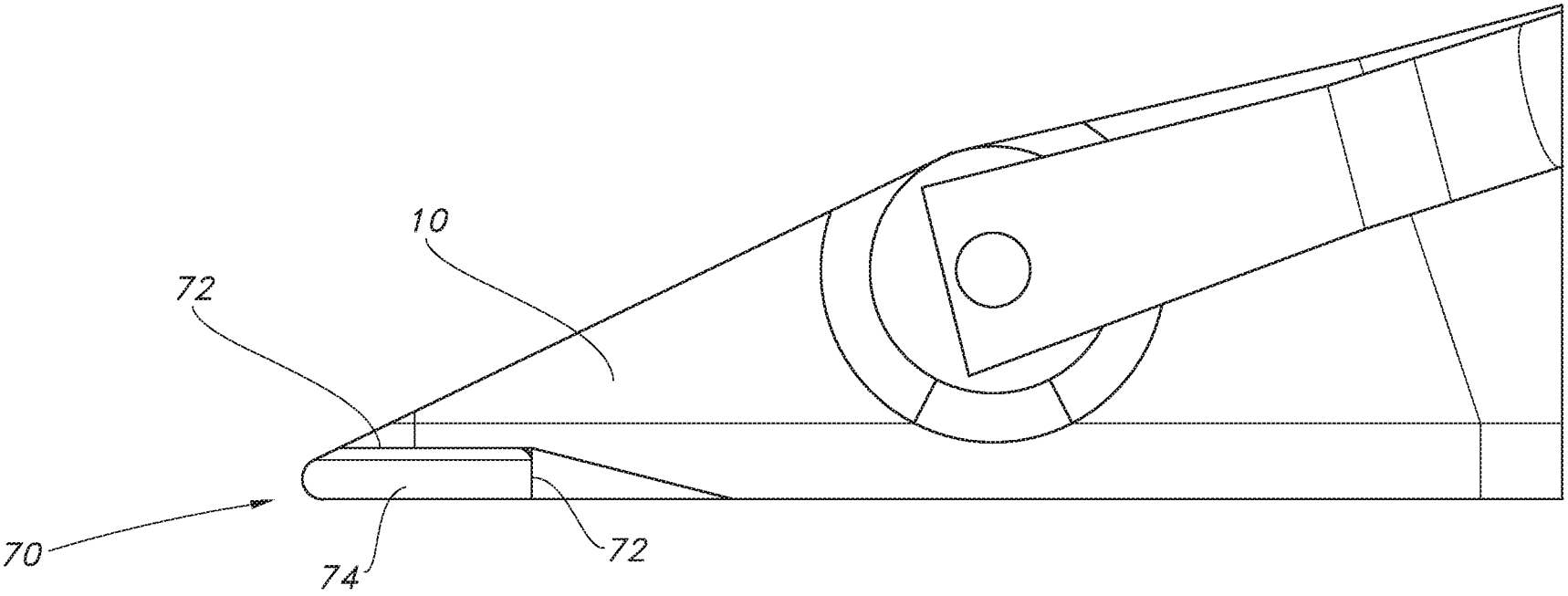
FIG. 15 is a side view of the scoop with a lip.
Figure 16:
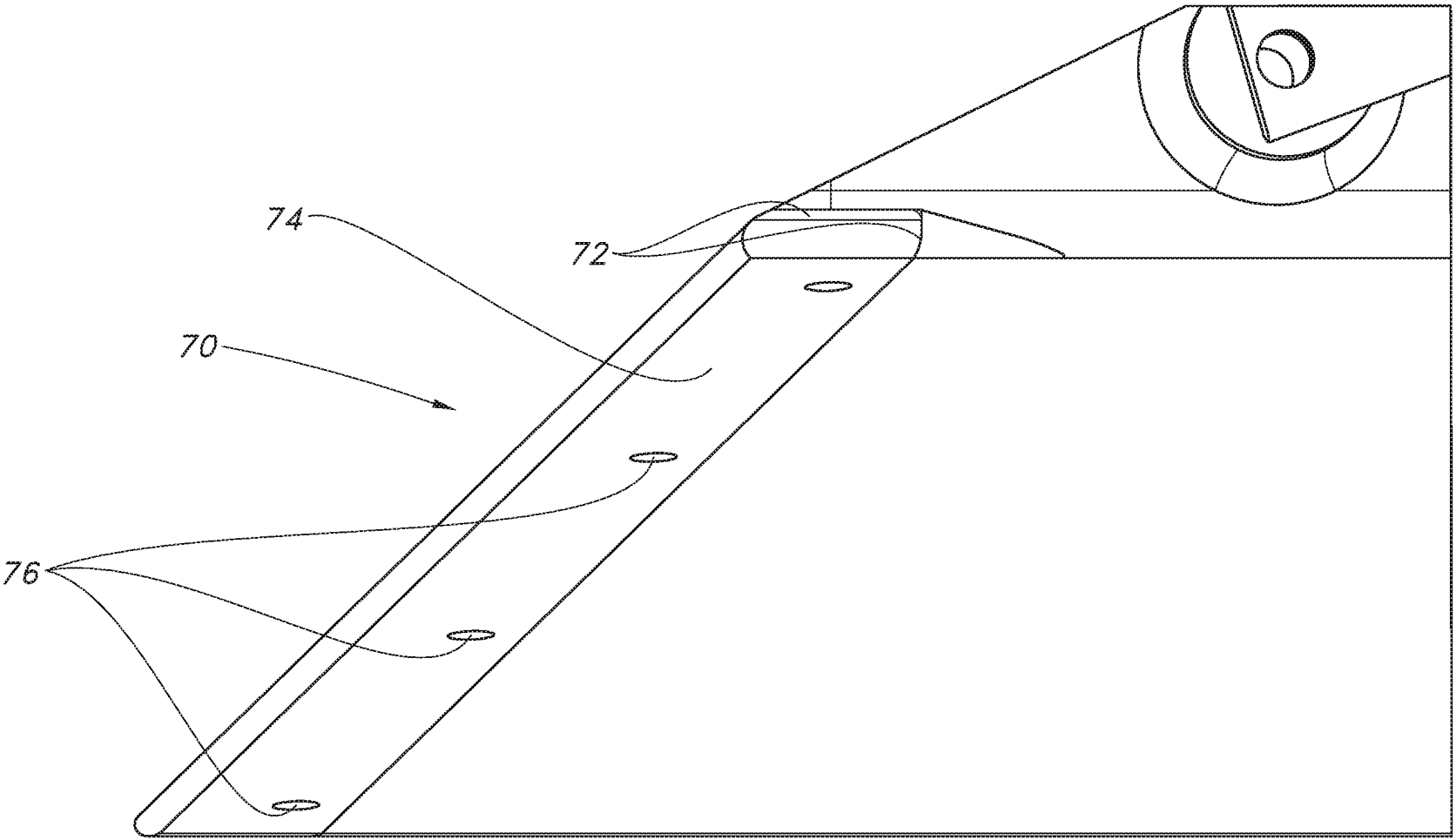
FIG. 16 is a bottom perspective view of the lip attached to the scoop.
Figure 17:
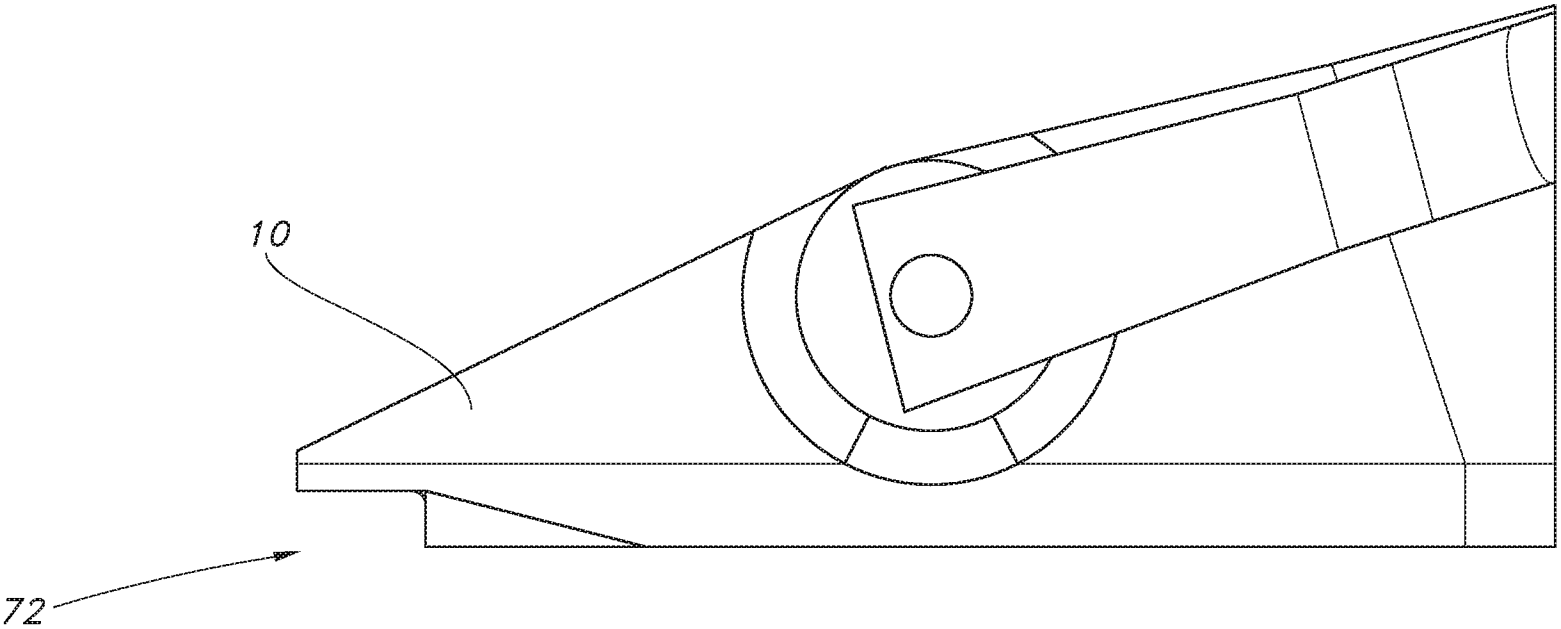
FIG. 17 is a side view of the scoop without the lip.

Another manner for creating the sliding effect is illustrated in FIGS. 11 & 12, whereby upper bar 62 and lower bar 64 are parallel guide bars that extend outward and away from the lifting mechanism with one on either side of the handle. A lower stop 38 may be provided on the handles 30 to prevent the lifting mechanism 50 from tilting the bucket too far forward.

FIGS. 13-17 illustrate the addition of a protective lip 70 to the front of the scoop 10. As previously noted, the scoop is likely to be made of a material such as high-density polyethylene, or fiber glass, or carbon fiber. While these types of materials are durable and very functional for their purpose, they also tend to cause a harsh and unpleasant noise as they scrape across many common surfaces such as pavement or concrete. The scoop is formed with a slight cutout 72, and a highly durable plastic member 74 is formed to fit in the cutout 72 and be secured in place by conventional fasteners 76. The plastic member 74 may be made of a number of suitably durable materials, such as, for example, a thermoplastic polyethylene such as ultra-high molecular weight polyethylene, high-modulus polyethylene, and/or similar such high density and/or high durability plastics. This combination allows the scoop to maintain its durability while alleviating the harsh sound of scraping on macadam or concrete.

It is understood that the embodiments described herein are merely illustrative of the present invention. Variations in the construction of the scooping device may be contemplated by one skilled in the art without limiting the intended scope of the invention herein disclosed and as defined by the following claims.

What is claimed is:

1. A scooping device adapted to move bulk materials, the scooping device comprising:

a handle that is pivotably connected to a scoop, and a lifting mechanism that is slideably coupled to the handle and pivotably coupled to the scoop, the scoop having a first sidewall and a second sidewall, the lifting mechanism further including a foot pedal;

the handle having a first handle arm, a second handle arm, and a gripping area between the first handle arm and second handle arm, and wherein either the first handle arm or the second handle arm is pivotably coupled to the scoop's first sidewall and the other of the first handle arm or the second handle arm is pivotably coupled to the scoop's second sidewall;

the lifting mechanism, having a first lifting arm and second lifting arm;

wherein the scoop has a front end that has an opening, a back end that forms a closed wall, a first sidewall, and second sidewall, each of the first sidewall and second sidewall extending from a position at or near the front end to a position at or near the back end;

wherein one of the first lifting arm or the second lifting arm is coupled to the first handle arm and to the first sidewall and the other of the first lifting arm or second lifting arm is coupled to the second handle arm and the second sidewall;

wherein operating the foot pedal in a downward manner causes the scoop to pivot forward.

2. The scooping device of claim 1, wherein the first sidewall and second sidewall are tapered and connected to the back end.

3. The scooping device of claim 1, wherein the first lifting arm and the second lifting are moveable along the handle via parallel guide bars.

4. The scooping device of claim 1, wherein the first lifting arm and the second lifting arm are slideably coupled to the first handle arm and the second handle arm by sleeves.

5. The scooping device of claim 1, wherein the first lifting arm and second lifting arm are pivotably coupled to the first sidewall and second sidewall at a location at or near the front end of the scoop.

6. The scooping device of claim 1 wherein the scoop includes a protective lip.

7. The scooping device of claim 6 wherein the lip is comprised of a thermoplastic polyethylene.

8. The scooping device of claim 1, wherein the handle is foldable.

* * * * *